United States Patent [19]

Wolf

[11] B 3,998,341

[45] Dec. 21, 1976

[54] PUBLIC WORKS MACHINE EQUIPPED WITH A BUCKET UNLOADING DEVICE

[75] Inventor: Didier Albert Wolf, Meaux, France

[73] Assignee: Societe Anonyme: Poclain, Le Plessis-Belleville, France

[22] Filed: Dec. 26, 1974

[21] Appl. No.: 536,403

[44] Published under the second Trial Voluntary Protest Program on March 23, 1976 as document No. B 536,403.

[30] Foreign Application Priority Data

Jan. 22, 1974 France ..... 74.2129

[52] U.S. Cl. ..... 214/90 R; 214/146 E

[51] Int. Cl.[2] ..... B65G 47/00

[58] Field of Search ..... 214/146 R, 146 E, 90 R, 214/90 A, 44 A

[56] References Cited

UNITED STATES PATENTS 2,384,242 9/1945 Fitch ..... 214/90 R

*Primary Examiner*—Robert G. Sheridan

*Attorney, Agent, or Firm*—Lewis H. Eslinger

[57] ABSTRACT

This invention relates to a public works machine equipped with a bucket unloading device. According to the invention, this device comprises an endless member mounted for movement or translation along the jib and comprising blades, a chute disposed under the jib capable of being swept by said blades and a bucket whose section is identical to that of said chute, the shoot-bucket assembly then being completely swept by the blades. The material contained in the bucket is pushed via the shoot onto a conveyer belt which evacuates it to the rear of the machine.

3 Claims, 2 Drawing Figures

PUBLIC WORKS MACHINE EQUIPPED WITH A BUCKET UNLOADING DEVICE

The invention finds advantageous application in the field of public works machines.

The present invention relates to a public works machine comprising a bucket unloading device.

The bucket of a public works machine is generally unloaded above a conveying means (lorry, wagon, belt . . . ), by being pivoted to allow the material that it contains to drop by gravity. Now, the turret of the machine has to be rotated prior to this unloading, since the conveying means is obviously not in the same zone as the loading zone of the bucket. This rotation means that the machine must be immobilised and thus limits its economic viability. In fact, the time taken for these operations is a considerable part of the total working time of the machine and, during this time, the machine does not work at maximum power.

Attempts have been made to obviate this drawback in known devices, by connecting a conveyer belt to the turret for transferring the material from the front to the rear and thus avoiding the rotation of said turret. However, the devices used for unloading the bucket on this belt are often of complicated kinematics and this leads to prohibitive cost price and maintenance costs of the machine.

The present invention intends to remedy these drawbacks by proposing a simple device for unloading a bucket onto a conveyer belt, particularly applicable to a backhoe public works machine.

To this end, it has for its object a public works machine comprising a jib articulated on a structure by one of its ends, its other end having articulated thereon a balance beam bearing at its free end a backhoe bucket. The said jib is provided over a part of its length at the structure end, with an endless member that may be moved in translation along the jib, in the direction towards the bucket end of the jib for its upper edge and in the reverse direction for its underside, said member comprising transverse blades which are perpendicular thereto, distributed regularly over the whole of its length.

The lower part of said jib comprises in addition a chute open at its two ends and extending over a part of the length of the endless member so that the blades on the underside pass therethrough. Finally, said bucket has a section identical to that of said chute and may be placed in position by the balance beam in line with said chute at its end turned towards the end of the jib, and the chute bucket assembly may be entirely swept by the said plates.

The invention wll be more readily understood on reading the following description with reference to the accompanying drawings, in which.

Figure 1:
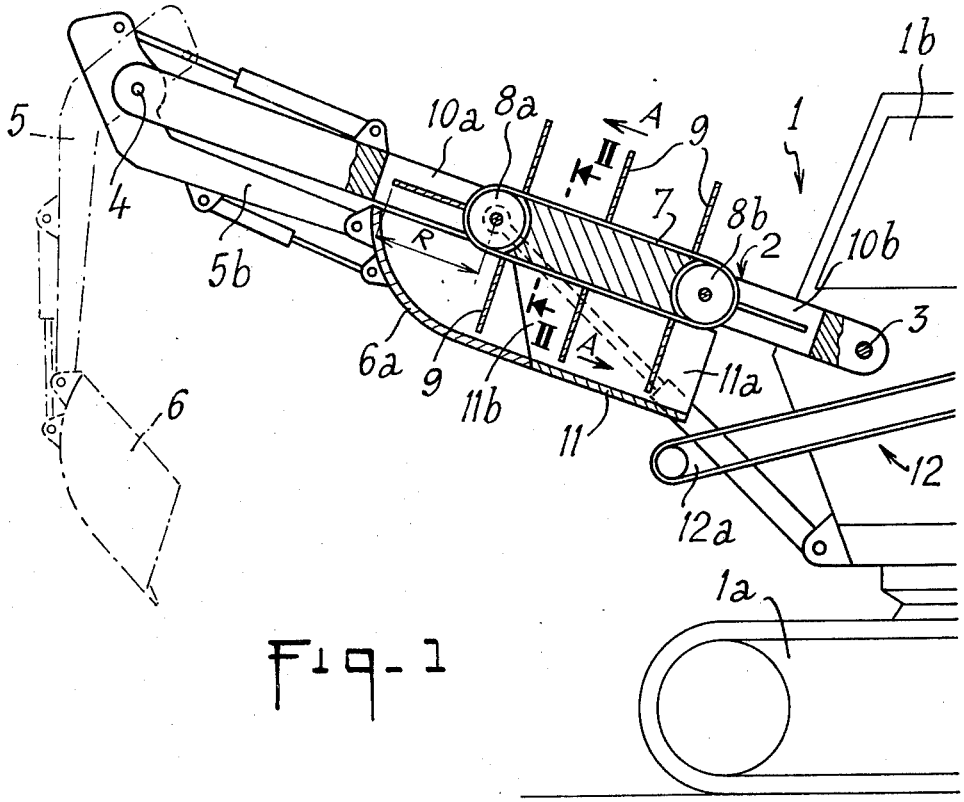
FIG. 1 is a schematic view of a machine according to the invention.

Referring now to the drawings, FIG. 1 shows a public works machine constituted by a structure 1 comprising, in particular, a chassis 1*a* and a turret 1*b*. A jib 2 is articulated at 3 on this structure and carries a balance beam 5 via articulation 4. Said balance beam is provided at its end with a backhoe bucket 6. The relative movements of each of these elements with respect to one another are conventionally ensured by hydraulic jacks. In this Figure, a partial longitudinal section has been made through the jib 2 to show that it is provided with an endless member or conveyor 7 over a part of its length at the machine end. This member 7, e. g. an endless belt, is driven in translation by one of the wheels 8*a* and 8*b* on which it winds, which may be a driving wheel known per se. The movement of the member 7 is such as is indicated in the Figure by arrows A.

Transverse blades 9 are fixed perpendicularly to the member 7 and are regularly distributed over the whole of its length. They therefore move with the member 7 and the jib 2 is shaped in such a manner that it has openings 10*a* and 10*b* at the ends of the member 7 through which the blades 9 pass. A chute 11 also shown in section in this Figure, is connected beneath the jib 2. It is open at its two ends 11*a* and 11*b* so that it is swept by the blades 9 when they move. The surface of these blades is slightly smaller than the section of the chute.

5*b* represents the position taken by the balance beam when the bucket 6 is brought in line with the chute 11 in its position 6*a*. In this position, this bucket is also shown in section. Its transverse section is identical to that of the chute 11. It will have been noted that the length of the chute 11 is such that it ensures a good positioning of the bucket 6 in its position 6*a* for given jib and balance beam lengths. Moreover, the shape of the end 11*b* of the chute 11 is complementary of that of the edges of the bucket 6. Furthermore, the radius of curvature of the bottom of the bucket 6 is slightly larger than the radius of maximum bulk R of the blades 9 in their rotation about wheel 8*a*. Finally, 12 schematises a conveyor belt connected in manner known per se to the structure 1 of the machine. It will be noted that its end 12*a* is located under the end 11*a* of the chute.

Figure 2:
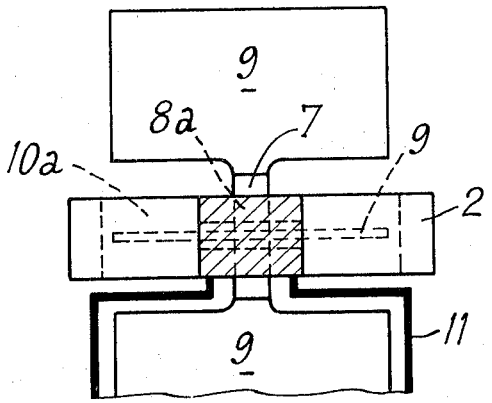
FIG. 2 is a section along line II—II of FIG. 1.

FIG. 2, which is a section along II—II of FIG. 1, shows most of the elements described in FIG. 1 with the same references. This FIG. 2 shows on an enlarged scale the transverse form of the jib 2 at its opening 10*a* and the room occupied by a blade 9 in the chute 11.

In operation, the bucket 6 is loaded in conventional manner and is then brought into its position 6*a* in line with the chute 11. This positioning is effected with the aid of the balance beam 5 and hydraulic members connected in conventional manner between the bucket and the balance beam. The conveyer means 7 is then started up either automatically or manually. The blades 9 integral therewith thus sweep all the volume beneath the jib defined by the bucket 6 and the chute 11.

The material contained in the bucket 6 is then pushed by said blades 9 through the chute 11 to the conveyer belt 12 on which it falls by gravity. Said belt ensures that the material is conveyed towards the rear of the machine into a lorry or wagon for example. The bucket 6 may then be returned to a loading position since its contents have been emptied by the blades 9. This return may automatically stop the operation of the member 7, which will start again when the bucket takes its position 6*a* again.

Due to the dispositions of the invention, the bucket is unloaded rapidly and it returns to a working and loading zone very quickly since said zone is reached by a single movement of the balance beam and the jib. This results in an improved overall yield of the machine.

The invention finds advantageous application in the field of public works machines.

What we claim is:

1. A public works machine including a bucket unloading device, and comprising, in combination, a support structure, a jib having first and second opposite ends and articulted on said structure at said first end, a balance beam articulated on said second end of said jib, said balance beam having a free end, a backhoe bucket pivotally mounted on the free end of said balance beam, an endless conveyor movably mounted on said jib and extending along a part of its length adjacent the first end of the jib, said endless conveyor having upper and lower flights which, during movement of the conveyor, respectively move along the jib in the direction towards the second end of the jib for said upper flight and in the reverse direction for said lower flight, said endless conveyor including transverse blades extending generally perpendicularly therefrom and being distributed regularly over the whole of its length, said jib including a chute mounted thereon enclosing a portion of the lower flight of said conveyor, said chute having a pair of opposite open ends which allow the lower flight of the endless conveyor and the blades thereon to pass therethrough, and said bucket having an open end and a cross-section which is substantially identical to that of said chute and is adapted to be placed in position by the balance beam in alignment with said chute with its open end adjacent the chute and facing towards the first end of the jib, whereby the chute-bucket assembly may be swept completely by said blades.

2. A machine as claimed in claim 1, wherein the said jib has a pair of spaced openings formed therein allowing passage of said endless conveyor and its blades therethrough as the conveyor moves between said upper and lower flights.

3. The machine as claimed in claim 1, including an endless conveyor belt connected to said structure and having a lower end located beneath the open end of the chute nearest the structure.

* * * * *